US006217653B1

(12) United States Patent
Ishino et al.

(10) Patent No.: US 6,217,653 B1
(45) Date of Patent: Apr. 17, 2001

(54) APPARATUS FOR APPLYING PRIMER

(75) Inventors: Shigeo Ishino, Niwa-Gun; Kimihiko Matsuzaki, Nagoya, both of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 08/982,420

(22) Filed: Dec. 2, 1997

(30) Foreign Application Priority Data

Dec. 3, 1996 (JP) ..... 8-322502

(51) Int. Cl.[7] ..... B05C 11/00
(52) U.S. Cl. ..... 118/270; 118/602; 118/266
(58) Field of Search ..... 118/270, 264, 118/602, DIG. 11, 266

(56) References Cited

U.S. PATENT DOCUMENTS 2,828,715 * 4/1958 Heyman et al. ..... 118/264
2,987,955 * 6/1961 Sassenburg ..... 118/264
4,622,241 * 11/1986 Keys ..... 118/264
5,788,772 * 8/1998 Kunieda et al. ..... 118/264

FOREIGN PATENT DOCUMENTS 9-24317 * 1/1997 (JP) .

* cited by examiner

*Primary Examiner*—Brenda A. Lamb
(74) *Attorney, Agent, or Firm*—Parkhurst & Wendel, L.L.P.

(57) ABSTRACT

An apparatus for applying a primer on an outer surface of a work having rod shape, includes an primer applying portion provided under the work in which the primer is immersed; a cap portion provided detachably to the primer applying portion, which prevents an inclusion of a water component in the air into the primer applying portion; a primer inlet provided to the primer applying portion through which the primer is supplied into the primer applying portion; and a primer outlet which discharges the primer from the primer applying portion in such a manner that a liquid level of the primer applying portion becomes constant in the primer applying portion. In the apparatus mentioned above, the primer is applied on the outer surface of the work having rod shape by rotating and moving the work on the primer applying portion.

9 Claims, 4 Drawing Sheets

APPARATUS FOR APPLYING PRIMER

BACKGROUND OF THE INVENTION

1. Field of the Invention

The present invention relates to an apparatus for applying a primer on an outer surface of a work having rod shape.

2. Related Art Statement

Generally, in the case of manufacturing for example a polymer insulator, a primer (under-coating member such as adhesives) is applied on an outer surface of an FRP core having a rod shape as a work, and then a shed made of for example silicone rubber is molded thereon. In this method, an operation for applying the primer on the outer surface of the FRP core is performed such that, an operator moves gauze in which the primer is immersed on the outer surface of the FRP core in a longitudinal direction under a contact manner, while he rotates the FRP core every 120°. Moreover, in this primer applying operation, if it is necessary to provide a portion, to which the primer is not applied, at both ends of the outer surface of the FRP core which are connected with a metal flange, a masking tape is adhered to the portion to which the primer is not applied, and then the primer applying operation is performed.

However, in the known primer applying method mentioned above, since the operator applies the primer manually, the primer applying operation takes a lot of time and also it is difficult to apply the primer uniformly on the outer surface of the work. Moreover, in the case of providing the portion to which no primer is applied, it also takes a lot of time since the masking tape adhering and removing operations are troublesome.

In order to solve these problems of the known primer applying method, the present application proposed an apparatus and method of applying a coating member in Japanese Patent Laid-Open Publication No. 9-24317 (JP-A-9-24317). FIG. 4 is a schematic view showing one embodiment of the apparatus mentioned above. In FIG. 4, an accommodating chamber 51 is provided on a supporting plate 53 through a receiving member 52, and is divided into a lower chamber 51*a* and an upper chamber 51*b*. The lower chamber 51*a* is fixed on the supporting plate 53 and the upper chamber 51*b* is provided detachably on the lower chamber 51*a*. A primer inlet 55 to which a primer supply pipe 54 is connected is provided on a top portion of the upper chamber 51*b*. An overflow hole 56 for overflowing the primer is provided at a side wall of the lower chamber 51*a*.

Moreover, an elastic member 57 made of sponge in which bubbles are communicated with each other is divided into a lower elastic member 57*a* and an upper elastic muter 57*b* along a partition line from a communication hole 58. The lower elastic member 57*a* is accommodated exchangeablly in the lower chamber 51*a* and the upper elastic member 57*b* is accommodated exchangeablly in the upper chamber 51*b*. Supporting members 59 are made of an elastic material such as rubber whose hardness is larger than that of the sponge mentioned above. The elastic member 57 is sandwiched by the supporting members 59 toward a moving direction of a work 60. Through holes 61 having a taper shape communicated with the communication hole 58 are formed respectively at centers of the supporting members 59. Each supporting member 59 is divided into a lower supporting member 59*a* and an upper supporting member 59*b* along a partition line from the through hole 61.

In the apparatus for applying a primer mentioned above, the primer is supplied continuously into the accommodating chamber 51 through the primer supply pipe 54 and the primer inlet 55, and is discharged from the overflow hole 56. Therefore, it is possible to maintain the elastic member 57 always at a moist state by the primer. If the work 60 is rotated and moved along a longitudinal direction under such a condition, it is possible to automatically apply the primer on a predetermined portion of the work 60.

However, in the apparatus for applying a primer shown in FIG. 4, the present applicant found that the following problems occur.

(1) Special shape is required for the elastic member (sponge) for applying the primer, and thus a forming operation of the elastic member requires a lot of working steps.

(2) Every time a diameter of the work is changed, it is necessary to prepare the elastic member corresponding to the diameter of the work.

(3) A specific primer such as silane used for an adhesion between the FRP core and silicone rubber in the polymer insulator is hardened if being brought into contact with a water component in the air but it is never softened again by a solvent. Since the elastic member, to which the primer is applied, is brought into contact with a water component in the air every time the work is changed, there is a limitation for a successive use and it is necessary to change the elastic member frequently.

(4) Since the primer discharged from the overflow hole is brought into contact with the air, the primer is not used again and must be scrapped.

(5) The primer is uniformly immersed into the lower elastic member, but is not uniformly immersed into the upper elastic member. This is because the primer is uniformly immersed into a portion of the upper elastic member just beneath the primer inlet but is not uniformly immersed into a portion of the upper elastic member remote from the portion just beneath the primer inlet. Therefore, the primer is wasted for a running operation from a start of the primer applying operation to a state in which the primer applying operation becomes stable, and also the primer applying operation takes a lot of time for the running operation.

SUMMARY OF THE INVENTION

An object of the invention is to eliminate the drawbacks mentioned above and to provide an apparatus for applying a primer in which an affection of a water component in the air is few, and a uniform primer applying operation can be performed.

According to the invention, an apparatus for applying a primer on an outer surface of a work having rod shape, comprises an primer applying portion provided under said work in which said primer is immersed; a cap portion provided detachably to said primer applying portion, which prevents an inclusion of a water component in the air into said primer applying portion; a primer inlet provided to said primer applying portion through which said primer is supplied into said primer applying portion; and a primer outlet which discharges said primer from said primer applying portion in such a manner that a liquid level of said primer applying portion becomes constant in said primer applying portion, wherein said primer is applied on the outer surface of the work having rod shape by rotating and moving said work on said primer applying portion.

In the present invention, the primer applying portion is provided under the work, and thus it is possible to make a shape of the elastic member in the primer applying portion simple like a pole shape having a square cross section.

Therefore, the working operation of the elastic member becomes easy and the same primer applying portion can be used even if a diameter of the work is changed. Moreover, the cap portion is provided such that it covers the primer applying portion, and thus a water component in the air is not entered into a space between the cap portion and the primer applying portion since a vapor of a solvent in the primer is filled in this space. Therefore, it is possible to prevent a hardening of the primer during the primer applying operation. Further, as a preferred embodiment, in the case of supplying continuously an inert gas such as dry nitrogen into this space, it is possible to further effectively prevent the hardening of the primer.

Moreover, even in the case that the elastic member of the primer applying portion is brought into contact with a water component in the air and is hardened due to a work change and soon, if a cross sectional shape of the elastic member is square, it is possible to use four main planes of the elastic member respectively and successively for the primer applying operation, and thus a life of the elastic member can be increased by four times as compared with the known one. In this manner, it is possible to use the elastic member successively by only changing a main plane of the elastic member to which the work is contacted. Moreover, it is not necessary to change the elastic member frequently.

Moreover, as a preferred embodiment, in the case that a system comprising a primer chamber for accommodating the primer to be supplied, a pump for supplying the primer in the primer chamber to a primer inlet, the primer applying portion, a pump for discharging the primer from a primer outlet, is isolated from the atmosphere, the primer discharged from the primer outlet is not brought into contact with a water component in the air and is not hardened, and thus the elastic member can be used successively.

Further, as a preferred embodiment, in the case that the primer inlet is provided at a side lower portion of the primer applying portion which situates at a work insertion side, the primer outlet is provided at a side upper portion of the primer applying portion which situates at a work discharge side, and an elastic member made of preferably sponge in which bubbles are communicated with each other having a communication gap for sucking up the primer by its capillary action is provided in the primer applying portion, the primer is moved up naturally by its capillary action and thus it is possible to always maintain a surface of the elastic member to which the work is contacted in a moist state. Therefore, the primer can be applied uniformly on the work, and a material and time required for a running from a start of the primer applying operation to a state in which the primer applying operation becomes stable can be reduced. In this case, it is further preferred that pumps are provided at a primer supply side and a primer discharge side, and primer supplying and discharging operations are controlled.

DESCRIPTION OF THE PREFERRED EMBODIMENT

Figure 1A:
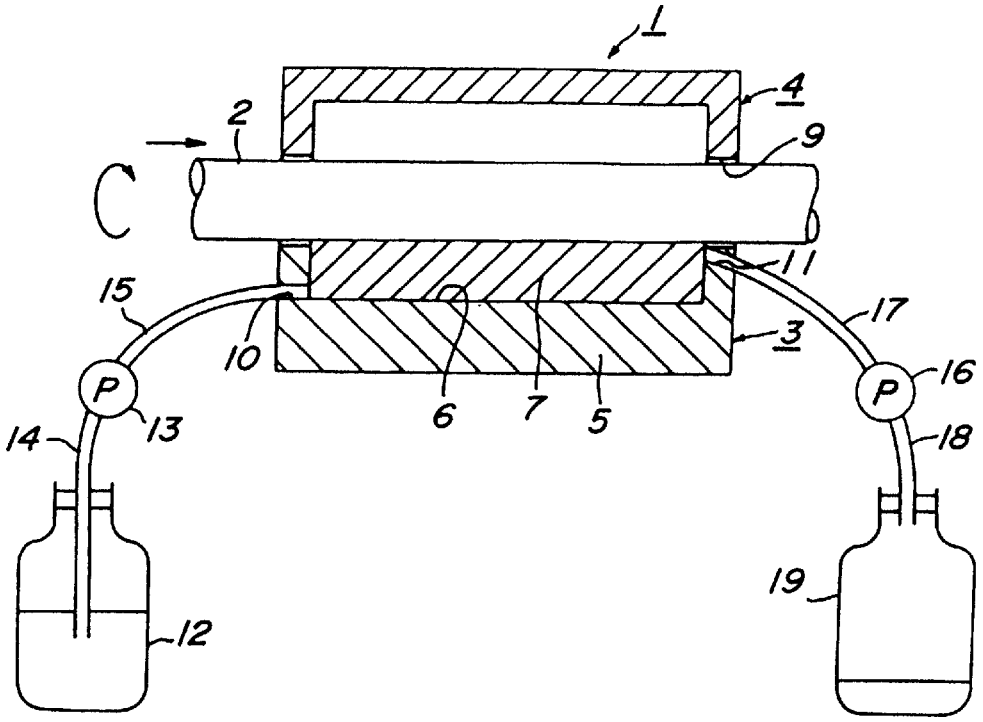
FIGS. 1*a* and 1*b* are schematic views respectively showing one embodiment of an apparatus for applying a primer according to the invention.
Figure 1B:
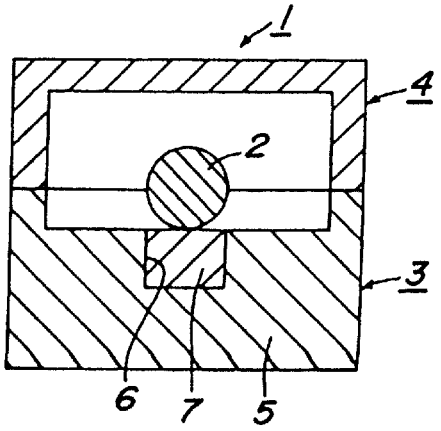

FIGS. 1*a* and 1*b* are schematic views respectively showing one embodiment of an apparatus for applying a primer according to the invention. In FIG. 1, FIG. 1*a* shows a lateral sectional view and FIG. 1*b* illustrates a longitudinal sectional view. In the embodiment shown in FIGS. 1*a* and 1*b*, an apparatus for applying a primer 1 according to the invention comprises an primer applying portion 3 provided under an FRP core 2 as a work and a cap portion 4 provided on the primer applying portion 3 in such a manner that it covers the primer applying portion 3.

Figure 2A:
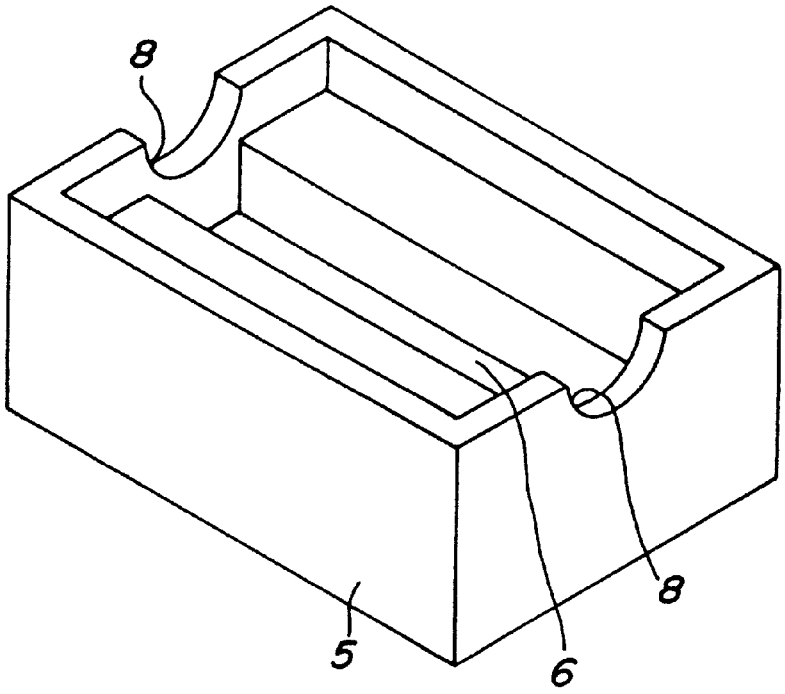
FIGS. 2*a* and 2*b* are schematic views respectively illustrating one embodiment of an primer applying portion of the apparatus for applying the primer according to the invention.
Figure 2B:
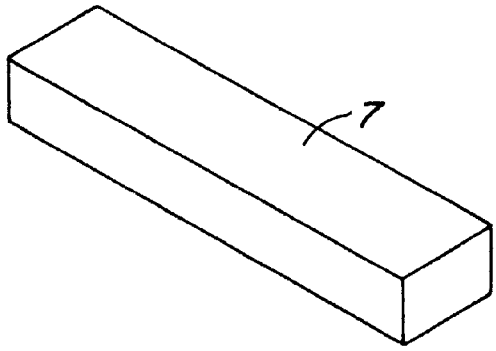

As shown in FIGS. 2*a* and 2*b* as its perspective view, the primer applying portion 3 comprises a chamber 5 made of metal such as stainless steel and an elastic member 7 provided detachably in a recess portion 6 formed in the chamber 5 in a work moving direction. At both side walls of the chamber 5, through holes 8 through which the FRP core 2 is inserted and discharged are respectively provided. Each through hole 8 is provided such that its lower end is positioned at a portion equal to or lower than an upper end of the elastic member 7. In the same manner, at both side walls of the cap portion 4, through holes 9 through which the FRP core 2 is inserted and discharged are respectively provided.

The through holes 8 and 9 construct through holes each having a diameter little larger than that of the FRP core 2. Moreover, the primer applying portion 3 comprises a primer inlet 10 provided at a portion corresponding to a lower end of the elastic member 7 at a work inserting side, and a primer outlet 11 provided at a portion corresponding to an upper end of the elastic member 7 at a work discharging side. A primer, in which silane is dissolved by a solvent for example, is supplied to the elastic member 7 of the primer applying portion 3 through the primer inlet 10 and is discharged out of the apparatus 1 through the primer outlet 11. That is to say, the primer in a primer chamber 12 is supplied to the primer inlet 10 through pipes 14 and 15 by means of a pump 13. The primer is discharged from the primer outlet 11 through pipes 17 and 18 by means of a pump 16. The pumps 13 and 16 are controlled by a controller not shown in such a manner that a primer supplying amount and a primer discharging amount are a predetermined level.

A shape of the elastic member 7 is not limited specifically, but, in the present embodiment, the elastic member 7 has a square cross sectional shape. All the surfaces of the elastic member 7 other than a surface to which the FRP core 2 is contacted are shielded with respect to an outer portion by means of the recess portion 6 of the chamber 5. Therefore, if a water component in the air is brought into contact with the surface of the elastic member 7 to which the FRP core 2 is contacted and the surface is hardened, it is possible to perform the next primer applying operation by only changing the surface to which the FRP core 2 is contacted without changing the elastic member 7 itself. Moreover, as the elastic member 7, it is possible to use a material having a communication gap such as sponge, brush, fiber, and so on which can suck up the primer by its capillary action, and preferably use a sponge in which bubbles are communicated with each other nondirectionally.

The embodiment mentioned above shows a main portion of the apparatus 1 according to the invention. Actually, the apparatus 1 according to the invention has a drive apparatus for rotating and moving the FRP core 2 in an arrow direction in FIG. 1*a* and a close and open apparatus for closing and opening the primer applying portion 3 and the cap portion 4 when the FRP core 2 is set to the apparatus 1 or when the FRP core 2 is discharged after the end of the primer applying operation. However, these apparatuses mentioned above have no specific features, and thus it is possible to use the known apparatuses i.e. the apparatuses disclosed in JP-A-9-24317.

Figure 3A:
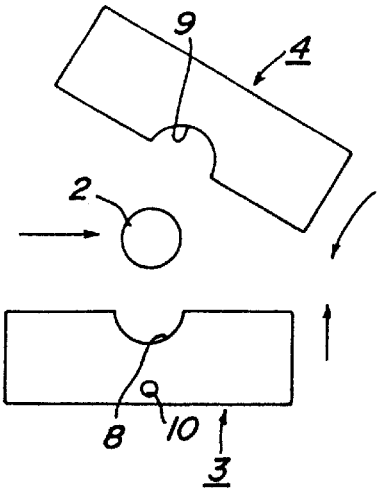
FIGS. 3*a*–3*e* are schematic views respectively for explaining a primer applying operation in the apparatus for applying the primer according to the invention.
Figure 3B:
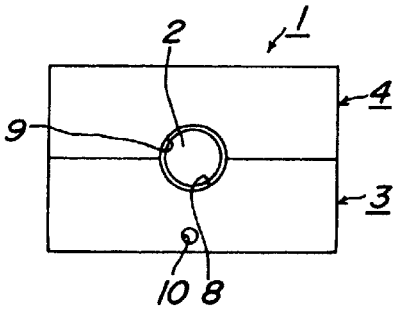

A primer applying operation in the apparatus 1 for applying a primer according to the invention is as follows. At first, as shown in FIG. 3*a,* the primer applying portion 3 and the cap portion 4 are opened by means of a close and open apparatus not shown. Then, as shown in FIG. 3*b,* the FRP core 2 is set to the apparatus 1 for applying a primer by closing the primer applying portion 3 and the cap portion 4. In this case, the FRP core 2 is set in the through holes each defined by the through holes 8 and 9. Moreover, in this case, as shown in FIG. 3*c,* it is possible to form a portion to which no primer is applied by projecting a leading end of the FRP core 2 at a predetermined distance fry the apparatus 1.

Figure 3C:
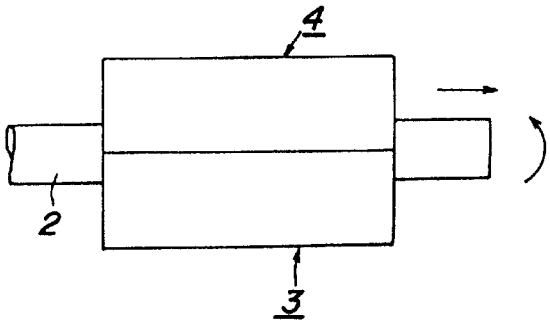
Figure 3D:
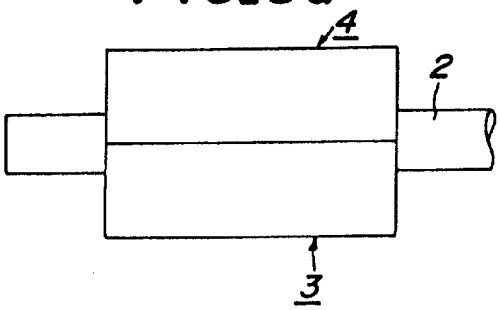
Figure 3E:
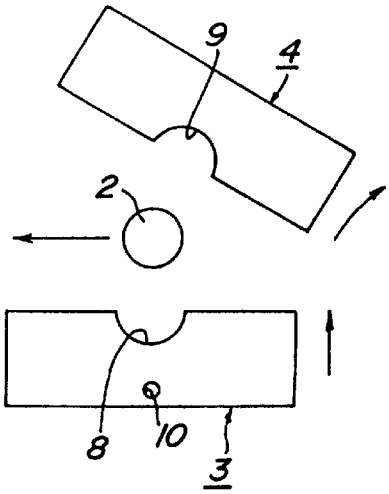
Figure 4A:
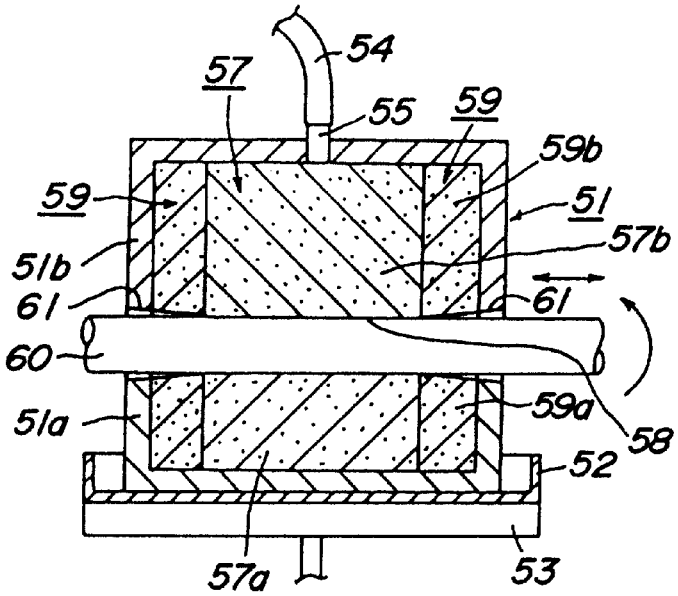
FIG. 4a PRIOR ART
FIGS. 4*a* and 4*b* are schematic views respectively showing one embodiment of a known apparatus for applying a primer proposed by the applicant.
Figure 4B:
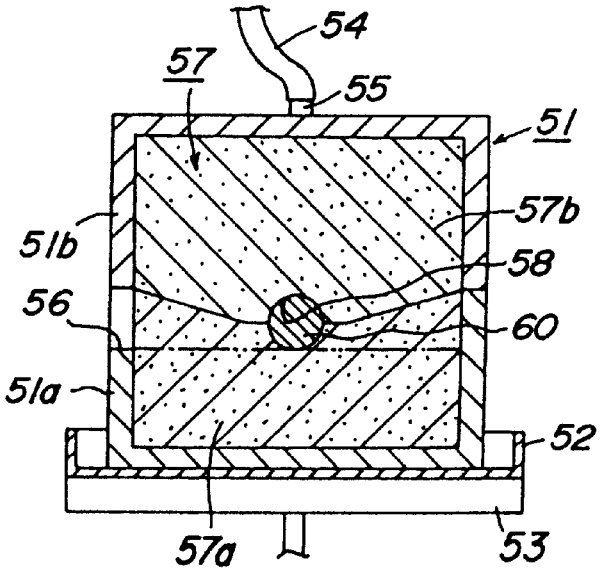
FIG. 4b PRIOR ART

Then, as shown in FIG. 3*c,* the FRP core 2 is moved in a work proceeding direction i.e. in an arrow direction at a constant speed while rotating as shown in an another arrow direction by a drive apparatus not shown. Then, as shown in FIG. 3*d,* the primer applying operation is stopped when the primer applying operation is finished with respect to a portion to which the primer is to be applied. Finally, as shown in FIG. 3*e,* the FRP core 2 is discharged from the apparatus 1 by opening the primer applying portion 3 with respect to the cap portion 4.

As mentioned above, in the case that the FRP core 2 is set to the apparatus 1 and in the case that the FRP core 2 is discharged from the apparatus 1, the cap portion 4 is opened with respect to the primer applying portion 3. Therefore, it is possible to prevent a damage of the elastic masher 7 of the primer applying portion 3 due to the and portions of the FRP core 2, which is generated when the FRP core 2 is set to or discharged from the apparatus 1. Moreover, the primer supplied from the primer inlet 10 to the elastic member 7 of the primer applying portion 3 is naturally and uniformly increased to the surface of the elastic member 7, to which the FRP core 2 is contacted, by the capillary action of the elastic member 7. In addition, a liquid level of the primer in the elastic member 7 is always maintained constantly by discharging a residual primer from the primer outlet 11. Therefore, it is possible to apply the primer uniformly on the outer surface of the FRP core 2. Further, the space between the primer applying portion 3 and the cap portion 4 is filled with a vapor of a solvent in the primer. Therefore, it is possible to prevent an inclusion of the air through gaps between the through holes 8, 9 and the FRP core 2, and thus it is possible to prevent a hardening of the primer during the primer applying operation.

Moreover, as an another embodiment, a system comprising the primer chamber 12 for accommodating the primer to be supplied; the pump 13; the piped 14 and 15; the primer inlet 10, the chamber 5 for accommodating the elastic member 7 and the primer outlet 11 of the primer applying portion 3; the pump 16; the pipes 17 and 18; and the primer chamber for accommodating the discharged primer is isolated from the atmosphere. In this case, the primer discharged from the primer outlet 11 is never brought into contact with a water component in the air, and thus the primer is not hardened. Therefore, it is possible to use the primer again, ant thus it is a preferred embodiment. Further, as a still another embodiment, an inert gas such as a dry nitrogen gas is supplied continuously into the space between the primer applying portion 3 and the cap portion 4 so as to prevent an inclusion of a water component in the air into the space mentioned above. In this case, a hardening of the primer during the primer applying operation can be prevented more effectively, and thus it is a preferred embodiment.

As mentioned above, according to the invention, since the primer applying portion is provided under the work, it is possible to make a shape of the elastic member in the primer applying portion simple like a pole shape having a square cross section. Therefore, the working operation of the elastic member becomes easy and the same primer applying portion can be used even if a diameter of the work is changed. Moreover, since the cap portion is provided such that it covers the primer applying portion and a vapor of a solvent in the primer is filled in this space, a water component in the air is not entered into a space between the cap portion and the primer applying portion. Therefore, it is possible to prevent a hardening of the primer during the primer applying operation. Further, since the primer is increased to the surface of the elastic member by its capillary action and a liquid level of the primer is maintained constantly, it is possible to apply the primer uniformly on the outer surface of the work.

What is claimed:

1. An apparatus for applying a primer to an outer surface of a rod-shaped member, comprising:

a primer applying portion provided under a path for said rod-shaped member for immersing the primer therein;

a cap portion detachably connected to said primer applying portion for preventing inclusion of a water component from the air into said primer applying portion;

a primer inlet operably connected to said primer applying portion for supplying the primer to said primer applying portion;

a primer outlet for discharging the primer from said primer applying portion in such a manner that a liquid level of said primer applying portion remains constant in said primer applying portion; and the flow path of the primer from the primer being supplied to the primer inlet to the primer being discharged from the primer outlet is in a closed system, wherein the primer is applied to the outer Surface of the member by rotating and moving the member relative to said primer applying portion.

2. The apparatus according to claim 1, further comprising means for opening said cap portion relative to said primer applying portion when a leading end of the member is inserted into the apparatus and when a trailing end of the member is discharged therefrom to prevent damage to said primer applying portion.

3. The apparatus according to claim 1, wherein said primer applying portion comprises an elastic member having a communication gap for withdrawing the primer by capillary action, and a chamber for shielding all the surfaces of said elastic member other than a surface for contacting the member.

4. The apparatus according to claim 3, wherein said elastic member comprises a sponge including holes in random communication with each other.

5. An apparatus for applying a primer to an outer surface of a rod-shaped member, comprising:

a primer applying portion for immersing a rod-shaped member therein;

a cap portion detachably connected to said primer applying portion for preventing inclusion of a water component from the air into said primer applying portion;

a primer inlet operably connected to said primer applying portion for supplying the primer to said primer applying portion;

a primer outlet for discharging primer from said primer applying portion so that a liquid level in said primer applying portion remains constant; and said primer applying portion having a member insertion side into which a rod-shaped member insertable, and a member discharge side from which a rod-shaped member is dischargable after having traveled therethrough, and wherein a primer inlet is directly connected to a lower portion of the member insertion side, and a primer outlet is directly connected to the upper portion of the member discharge side such that excess primer may flow upwardly and out of said primer outlet, wherein a primer may be applied to the outer surface of a rod-shaped member by rotating and moving the member relative to said primer applying portion.

6. The apparatus according to claim 5, further comprising supply and discharge pumps for controlling supply and discharge of the primer through said primer inlet and said primer outlet, respectively.

7. The apparatus according to claim 6, further comprising a primer chamber for accommodating the primer to be supplied, wherein said supply pump is connected for supplying the primer from said primer chamber to said primer applying portion, wherein said discharge pump is connected for discharging the primer from said primer outlet, and wherein said primer chamber is capable of accommodating the discharged primer.

8. The apparatus according to claim 7, wherein said primer chamber for accommodating the discharged primer is isolated from the air.

9. An apparatus for applying a primer to an outer surface of a rod-shaped member, comprising:

a primer applying portion for immersing a rod-shaped member therein;

a cap portion detachably connected to said primer applying portion for preventing inclusion of a water component from the air into said primer applying portion;

a primer inlet operably connected to said primer applying portion for supplying primer to said primer applying portion;

a primer outlet for discharging primer from said primer applying portion so that a liquid level in said primer applying portion remains constant; and means for supplying an inert gas into a space between said primer applying portion and said cap portion to prevent inclusion of air into said space, wherein primer may be applied to the outer surface of a rod-shaped member by rotating and moving such member relative to said primer applying portion.

* * * * *